US007261137B2

(12) United States Patent
Dekker

(10) Patent No.: US 7,261,137 B2
(45) Date of Patent: Aug. 28, 2007

(54) RETRACTABLE BLIND ASSEMBLY

(75) Inventor: Nicolaas Dekker, Barendrecht (NL)

(73) Assignee: Hunter Douglas Industries BV, El Rotterdam (NL)

( * ) Notice: Subject to any disclaimer, the term of this patent is extended or adjusted under 35 U.S.C. 154(b) by 250 days.

(21) Appl. No.: 11/035,355

(22) Filed: Jan. 12, 2005

(65) Prior Publication Data

US 2005/0150607 A1 Jul. 14, 2005

(30) Foreign Application Priority Data

Jan. 13, 2004 (EP) ..... 04075018

(51) Int. Cl.
*E06B 3/48* (2006.01)

(52) U.S. Cl. ..... 160/84.04; 160/84.07; 160/115; 160/87; 160/134

(58) Field of Classification Search ..... 160/74, 160/84.01, 84.04, 84.05, 84.06, 84.07, 87, 160/115, 134
See application file for complete search history.

(56) References Cited

U.S. PATENT DOCUMENTS

| | | | | |
|---|---|---|---|---|
| 3,646,986 | A * | 3/1972 | Anderle | 160/168.1 R |
| 4,518,025 | A * | 5/1985 | Judkins | 160/84.04 |
| 5,092,383 | A * | 3/1992 | Niemeijer et al. | 160/84.07 |
| 5,860,464 | A * | 1/1999 | Schon | 160/84.06 |

FOREIGN PATENT DOCUMENTS

| | | |
|---|---|---|
| EP | 0 532 036 A | 3/1993 |
| EP | 0 674 091 A | 9/1995 |
| EP | 1 120 534 A | 8/2001 |

* cited by examiner

*Primary Examiner*—Peter M. Cuomo
*Assistant Examiner*—Russell Bloodgood
(74) *Attorney, Agent, or Firm*—Dorsey & Whitney LLP

(57) ABSTRACT

A retractable blind assembly including a top section (3,103) with a vertically-extending blind covering material (23,123) extending between a fixed inclined head rail (5,105) and a middle rail (7,107) that is pivotable with respect to the head rail (5,105) about a pivot center that is adjacent to a lowermost end of the head rail, the head rail extending upwardly at an acute angle, the middle rail (7,107) being pivotable between a lower position, in which the middle rail extends horizontally, when the covering material is extended and an upper position, in which the middle rail extends upwardly at an acute angle and is adjacent the head rail, when the covering material is retracted, the covering material in the top section (3,103) having a generally triangular shape with an unattached short apex (13,113) about the pivot center and an opposite, unattached, long side (15,115) when the covering material is extended, a bottom section (9,109) with the covering material extending between the middle rail (7,107) and a horizontally-extending bottom rail (11,111), the bottom rail being movable vertically between the bottom of the blind when the covering material is extended and an upper position, adjacent the middle rail, when the covering material is retracted, at least first and second lift cords (17, 19, 117, 119) for extending and retracting the covering material, the lift cords being connected outside the blind to a cord connector (21,121), wherein the first lift cord (17,117) is routed through the top section (3,103) adjacent its apex and long side (13,15,113,115) and the second lift cord (19,119) is routed such that it passes through the top section between its apex and long side, and wherein when the covering material (23,123) is extended, the total length of the first lift cord (17,117) within the top section (3,103) is equal to the total length of the second lift cord (19,119) within the top section.

17 Claims, 8 Drawing Sheets

RETRACTABLE BLIND ASSEMBLY

CROSS REFERENCE TO RELATED APPLICATIONS

This application claims priority to European Application No. 04075018.4 filed 13 Jan. 2004.

BACKGROUND OF THE INVENTION

1. Field of the Invention

This invention relates to a retractable blind assembly for covering an irregularly shaped window area with an upper triangular portion and a lower rectangular portion. This invention particularly relates to a blind which can be retracted and extended by pulling and releasing a plurality of pull cords.

2. Description of the Relevant Art

It has been a continuing problem to provide retractable cord-operated blinds for covering irregularly shaped windows although solutions had been readily devised for strictly triangular and trapezoidal windows. Polygonal windows of the kind having a generally rectangular outline but with a corner "cut off" have been the most difficult to cover.

Among the attempts to develop suitable retractable cord-operated blinds for such windows with an upper triangular portion and lower rectangular portion are the blinds described in EP 0 532 036, EP 0 674 091 and EP 1 120 534. However, such blinds have not been easy to assemble. Moreover, the configuration and size of the windows that could be provided with such blinds have often been limited.

SUMMARY OF THE INVENTION

In order to provide a retractable blind assembly for covering a window area with an upper triangular portion and a lower rectangular portion that is easier to assemble and can be used with more configurations and sizes of windows, this invention relates to a blind (1), including:

- a top section with a vertically-extending blind covering material extending between a fixed inclined head rail and a middle rail that is pivotable with respect to the head rail about a pivot center that is adjacent to a lowermost end of the head rail; the head rail extending upwardly at an acute angle; the middle rail being pivotable between a lower position, in which the middle rail extends horizontally, when the covering material is extended and an upper position, in which the middle rail extends upwardly at an acute angle and is adjacent the head rail, when the covering material is retracted; the covering material in the top section having a generally triangular shape with an unattached short apex about the pivot center and an opposite, unattached, long side when the covering material is extended;
- a bottom section with the covering material extending between the middle rail and a horizontally-extending bottom rail; the bottom rail being movable vertically between the bottom of the blind when the covering material is extended and an upper position, adjacent the middle rail, when the covering material is retracted;
- at least first and second lift cords for extending and retracting the covering material; the lift cords being connected outside the blind to a cord connector;

characterized in that the first lift cord is routed through the top section adjacent its apex and long side and the second lift cord is routed such that it passes through the top section between its apex and long side, and wherein when the covering material is extended, the total length of the first lift cord within the top section is equal to the total length of the second lift cord within the top section.

Further aspects of the invention will be apparent from the detailed description below of particular embodiments and the drawings thereof, in which:

DESCRIPTION OF THE PREFERRED EMBODIMENT

Figure 1:
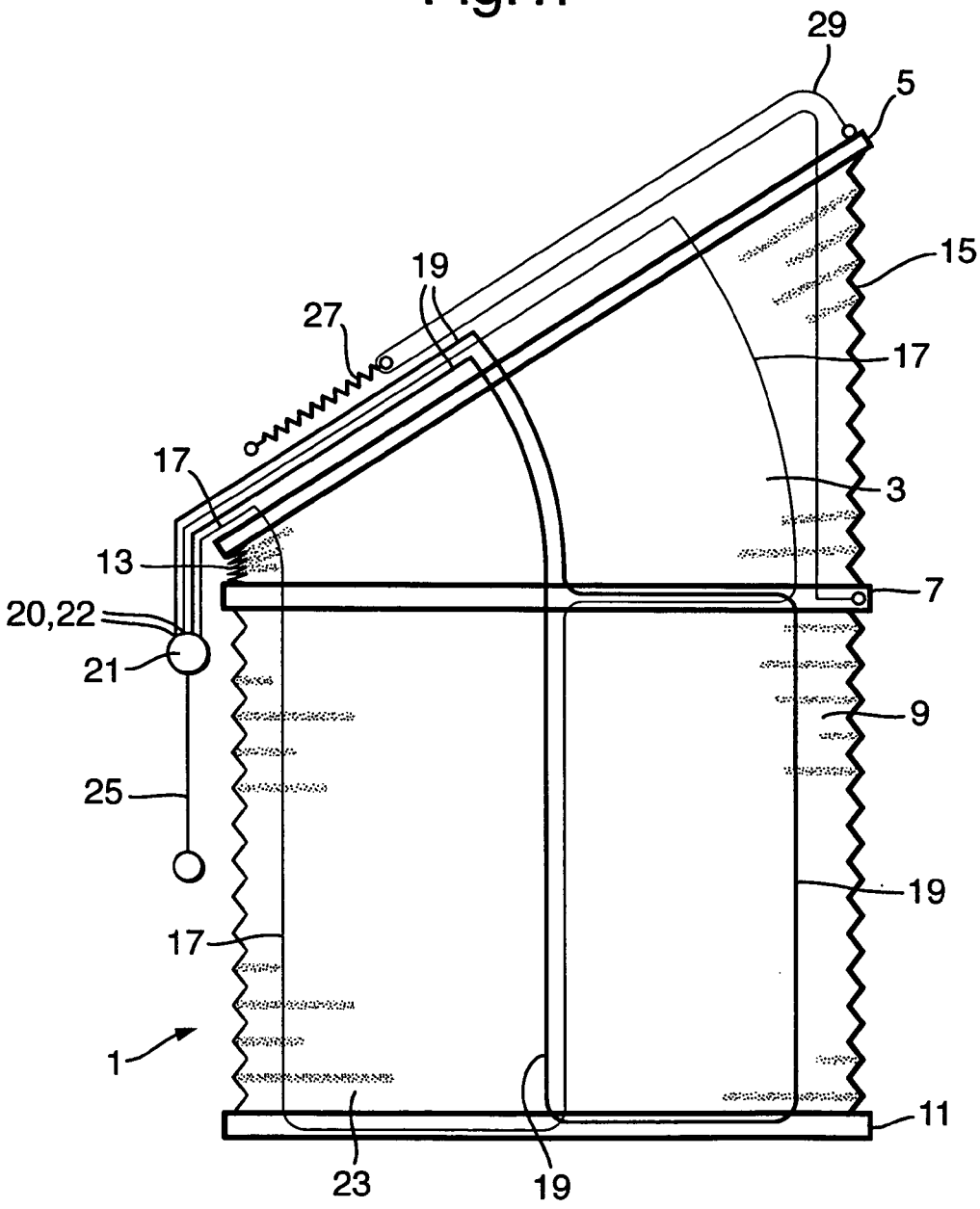
FIG. 1 is a schematic view of a first embodiment of a retractable blind assembly of this invention, with its pleated covering material extended.

FIG. 1 shows a retractable cord-operated blind 1 with a fixed inclined head rail or top rail 5 as a support structure and a raisable horizontally-extending bottom rail 11. Between the head rail 5 and bottom rail 11 is a middle rail 7 that is pivotable with respect to the head rail 5 about a pivot center that is adjacent to the lowermost left end of the head rail. Attached to the top, middle and bottom rails 5, 7, 11 are a pair of lift cords 17, 19 which extend, between the rails, through perforations in a covering member 23. The top and bottom edges of the covering member 23 are attached to the top and bottom rails 5 and 11, and a middle portion of the covering member is attached to the middle rail 7.

The covering material 23 has a generally triangular top portion and a generally rectangular bottom portion, and it is preferably made from a pleated material. The head rail 5 and middle rail 7 and the triangular top portion of the covering member 23, attached to them, form a top section 3 of the blind 1. The covering material 23 in the top section 3 has an unattached short apex 13 about the pivot center of the top section and an opposite, unattached, long side 15 when the covering material is extended. The middle rail 7 and bottom rail 11 and the rectangular bottom portion of the covering member 23, attached to them, form a bottom section 9 of the blind 1.

The blind 1 has a vertically-movable cord collector 21 outside of the blind. Attached to the cord connector 21 are both ends 20,22 of each of a pair of lift cords 17, 19. The lift cords 17, 19 extend from, and return to, the common cord collector 21 and are routed through, and deflected by, the head, middle and bottom rails 5, 7, 11 as shown in FIG. 1. A depending cord member 25 can manually actuate the collector 21. In this regard, the cord member 25 can be used to raise and lower the collector 21 to raise and lower the middle and bottom rails 7, 11 and thereby retract and extend the covering member 23 as described below.

The routing of the first lift cord 17 in the blind 1 in accordance with this invention is as follows (with reference to FIG. 1). The first lift cord 17 extends rightwardly through the head rail 5, away from the collector 21, and at a first guide in the bottom of the head rail, the first lift cord 17 extends downwardly to a first guide through the middle rail 7 that is adjacent—i.e., just to the right of—the apex 13 of the covering material 23 in the top section 3 and adjacent the left end of the middle rail. The first lift cord 17 then extends downwardly through the middle rail 7 to a first guide in the top of the bottom rail 11, adjacent its left end, and then rightwardly through the bottom rail to a second guide in the top of the bottom rail. The first lift cord then extends upwardly to a second guide in the bottom of the middle rail 7, midway between its ends, and then rightwardly through the middle rail to a third guide in the top of the middle rail, adjacent its right end. The first lift cord then extends upwardly, adjacent to—i.e., just to the left of—the long side 15 of the covering material 23 in the top section 3, to a second guide in the bottom of the head rail 5 and then leftwardly through the head rail back to the collector 21.

The routing of the second lift cord 19 in the blind 1 in accordance with this invention is as follows (with reference to FIG. 1). The second lift cord 19 also extends rightwardly through the head rail 5, away from the collector 21, and at a third guide in the bottom of the head rail—midway between the first and second guides in the head rail—the second lift cord 19 extends downwardly to a fourth guide through the middle rail 7. The fourth guide in the middle rail 7 can be adjacent to—i.e., just to the left of—the second guide in the middle rail as shown schematically in FIG. 1, but preferably, the second and fourth guides in the middle rail are coaxial. The second lift cord 19 then extends downwardly through the fourth guide in the middle rail to a third guide in the top of the bottom rail 11. The third guide in the top of the bottom rail 11 can be adjacent to—i.e., just to the left of—the second guide in the bottom rail as shown schematically in FIG. 1, but preferably, the second and third guides in the bottom rail are coaxial. The second lift cord then extends rightwardly through the bottom rail to a fourth guide in the top of the bottom rail, adjacent its right end. The second lift cord then extends upwardly to a fifth guide in the bottom of the middle rail 7, adjacent its right end, and then leftwardly through the middle rail to a sixth guide in the top of the middle rail 7. The sixth guide in the middle rail 7 can be adjacent to—i.e., just to the right of—the fourth guide in the middle rail as shown schematically in FIG. 1, but preferably, the sixth guide in the middle rail is coaxial with the second and fourth guides in the middle rail. The second lift cord then extends upwardly to a fourth guide in the bottom of the head rail 5 and then leftwardly through the head rail back to the collector 21. The fourth guide in the head rail 5 can be adjacent to—i.e., just to the right of—the third guide in the head rail as shown schematically in FIG. 1, but preferably, the third and fourth guides in the head rail are coaxial.

Thus, as seen from FIG. 1, the first lift cord 17 is routed through the top section 3 of the blind 1 adjacent the apex 13 and long side 15 of the covering material 23 in the top section. The second lift cord 19 is routed through the top section 3 between the apex and long side 13,15 of the covering material 23 in the top section. The total length of the first lift cord 17 within the top section 3 is equal to the total length of the second lift cord 19 within the top section 3 when the covering material is extended.

Preferably a spring 27 is also provided in the head rail 5. The left end of the spring 27 is attached to the left end of the head rail, and the right end of the spring is attached to one end of a support wire 29. The support wire 29 extends, within the head rail 5, rightwardly away from the spring to a fifth guide in the bottom of the head rail, adjacent its right end. The support wire 29 then extends downwardly to the right end of the middle rail 7 where the other end of the support wire 29 is attached. The spring 27 and support wire 29 prevent the right end of the middle rail 7 from pivoting downwardly below the left end of the middle rail, i.e., below horizontal.

When the cord member 25 is pulled downwardly, the cord collector 21 pulls the first and second pull cords 17 and 19 outwardly of the blind 1. This initially causes the first pull cord 17 to pull up the bottom rail 11 at its first and second guides and the second pull cord 19 to pull up the bottom rail 11 at its third and fourth guides until the middle and bottom rails are vertically adjacent to one another. Pulling the cord member 25 is further downwardly causes the first pull cord to pull up the middle rail 7 at its second and third guides and the second pull cord to pull up the middle rail at its fourth and fifth guides, while the first pull cord pulls up the bottom rail further at its first and second guides and the second pull cord pull up the bottom rail further at its third and fourth guides, so that both the middle and bottom rails pivot about the pivot center of the middle rail.

Figure 2:
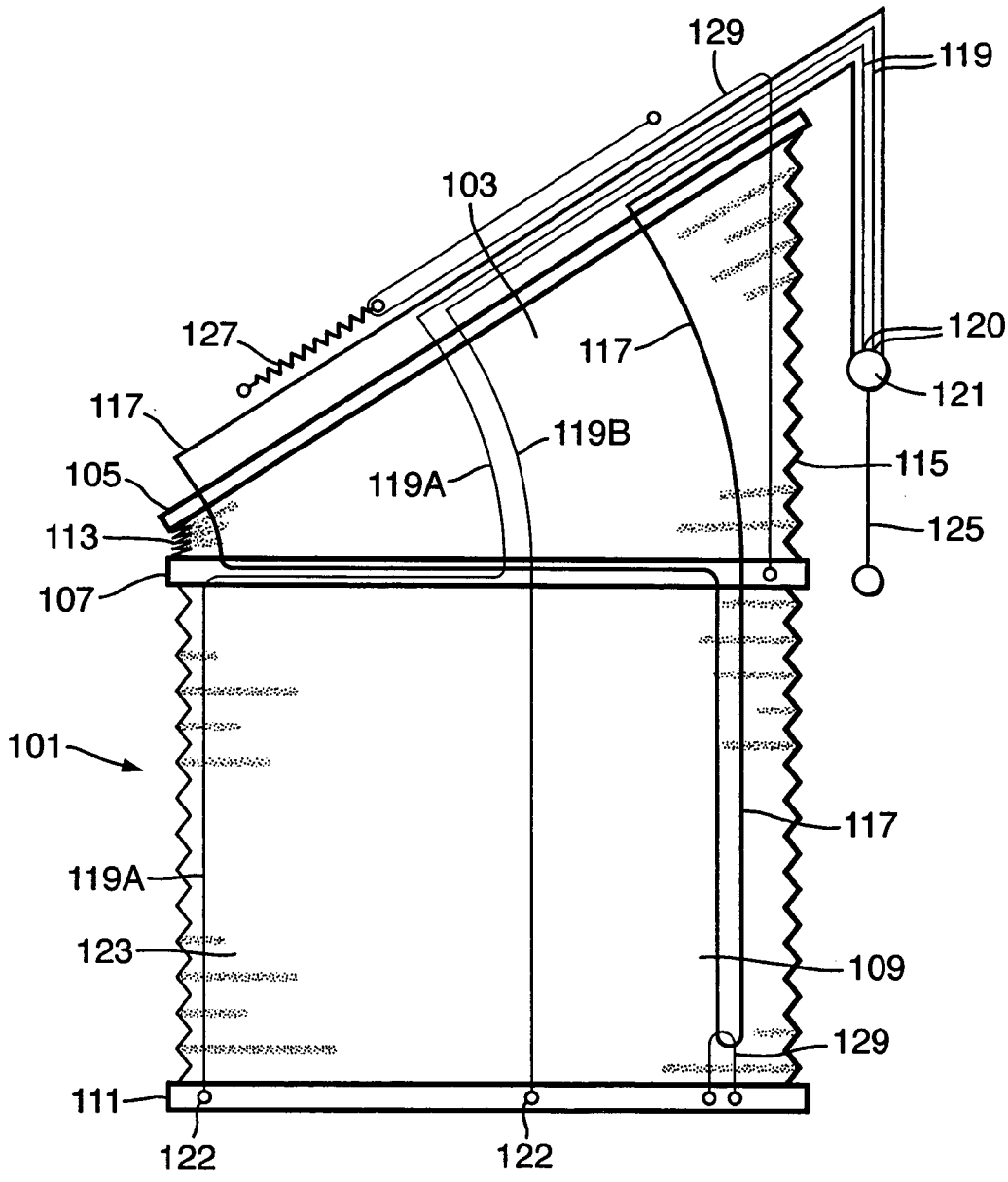
FIG. 2 is a schematic view of a second embodiment of a retractable blind assembly of this invention, with its pleated covering material extended.
Figure 3:
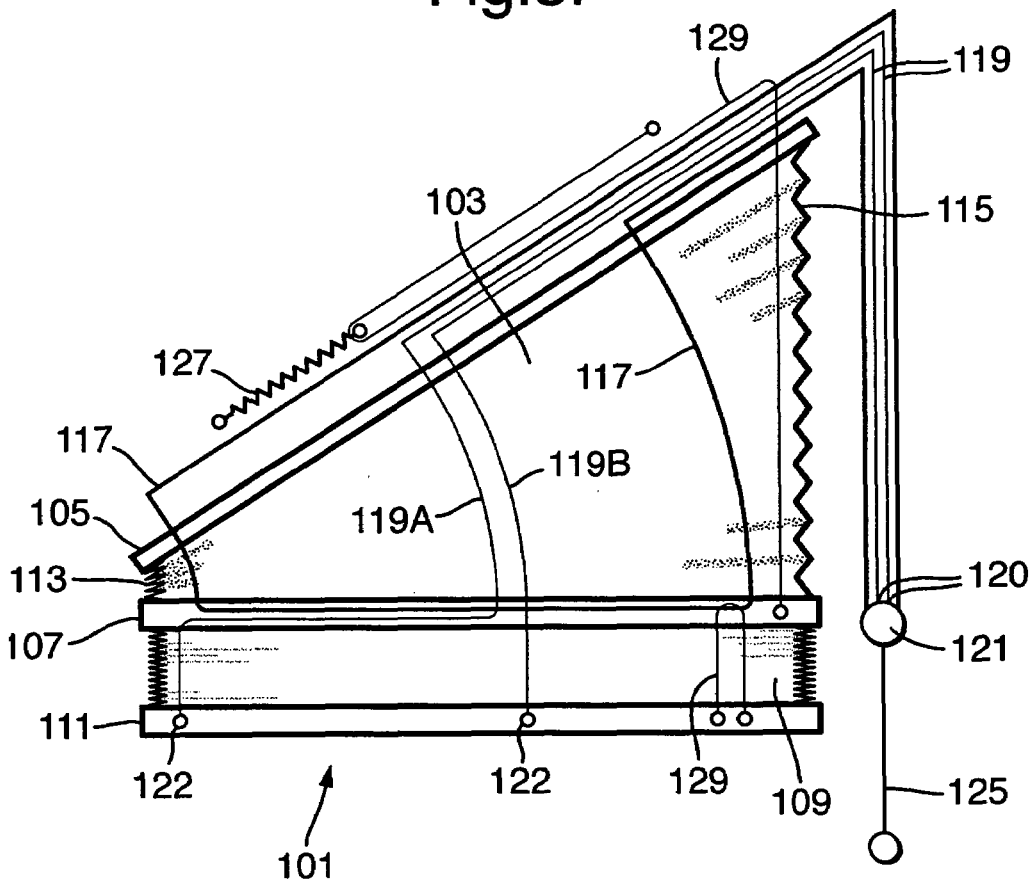
FIG. 3 is a schematic view of the second embodiment of a retractable blind assembly of FIG. 2, with its covering material partially retracted.

FIGS. 2 and 3 show a second embodiment of a blind 101 which is similar to the blind 1 of FIG. 1 and for which corresponding reference numerals (greater by 100) are used below for describing the same parts or corresponding parts.

The blind 101 includes a fixed inclined head rail 105 and a raisable horizontally-extending bottom rail 111. Between the head rail 105 and bottom rail 111 is a middle rail 107 that is pivotable with respect to the head rail 105 about a pivot center that is adjacent to the lowermost left end of the head rail. Attached to the top, middle and bottom rails 105, 107, 111 are a pair of lift cords 117, 119 which extend, between the rails, through perforations in a covering member 123, attached to the top, middle and bottom rails.

The head rail 105 and middle rail 107 and the triangular top portion of the covering member 123, attached to them, form a top section 103 of the blind 101 with an unattached short apex 113 about the pivot center of the top section and an opposite, unattached, long side 115 when the covering material is extended. The middle rail 107 and bottom rail 111 and the rectangular bottom portion of the covering member 123, attached to them, form a bottom section 109 of the blind 101.

The blind 101 has a vertically-movable cord collector 121 with a depending cord member 125 outside of the blind. Two lift cords 117, 119 are attached to the cord collector 121 and are routed through, and deflected by, the head, middle and bottom rails 105, 107, 111 as shown in FIGS. 2 and 3. Both ends of one of the lift cords 117 are attached to the collector. The other lift cord 119 comprises two lift cord parts 119A and 119B, and one end 120 of each lift cord part is attached to the collector and the other end 122 is fixed to the bottom rail 111. The cord member 125 can be used to raise and lower the collector 121 to raise and lower the middle and bottom rails 107, 111 and thereby retract and extend the covering member 123 as described below.

The routing of the first lift cord 117 in the blind 101 in accordance with this invention is as follows (with reference to FIGS. 2 and 3). The first lift cord 117 extends leftwardly through the head rail 105, away from the collector 121, to a first guide in the bottom of the head rail, adjacent its left end. The first lift cord 117 extends downwardly from the first guide in the head rail to a first guide in the top of the middle rail 107 that is adjacent—i.e., just to the right of—the apex 113 of the covering material 123 in the top section 103 and adjacent the left end of the middle rail. The first lift cord 117 then extends rightwardly through the middle rail 107 to a second guide in the bottom of the middle rail, adjacent its right end, and then extends downwardly around an upstanding wire loop 129 attached to the top of the bottom rail 111, adjacent its right end. The first lift cord then extends upwardly from the wire loop 129 through a third guide in the middle rail, adjacent its right end. The third guide through the middle rail 107 can be adjacent—i.e., just to the right of—the second guide in the middle rail as shown schematically in FIGS. 2 and 3, but preferably, the second and third guides in the middle rail are coaxial. The first lift cord 117 then extends upwardly from the third guide in the middle rail adjacent to—i.e., just to the left of—the long side 115 of the covering material 123 in the top section 103, to a second guide in the bottom of the head rail 105, adjacent its right end. The first lift cord then extends rightwardly through the head rail, from its second guide, back to the collector 121.

The routing of the separate parts 119A and 119B of the second lift cord 119 in the blind 101 in accordance with this invention is as follows (with reference to FIGS. 2 and 3).

One lift cord part 119A extends leftwardly through the head rail 105, away from one of its end 120 and the collector 121, and at a third guide in the bottom of the head rail—midway between the first and second guides in the head rail—it extends downwardly to a fourth guide in the top of the middle rail 107. The one lift cord part 119A then extends leftwardly through the middle rail 107 to a fifth guide in the bottom of the middle rail, adjacent its left end.

The fifth guide in the bottom of the middle rail 107 can be adjacent to—i.e., just to the right of—the first guide in the top of the middle rail as shown schematically in FIGS. 2 and 3, but preferably, the first and fifth guides in the middle rail are coaxial. The one lift cord part 119A then extends downwardly through the fifth guide in the middle rail and its other end 122 is attached to the top of the bottom rail 111, adjacent the left end of the bottom rail.

The other lift cord part 19B also extends leftwardly through the head rail 105, away from one of its end 120 and the collector 121, and at a fourth guide in the bottom of the head rail—midway between the first and second guides in the head rail—it extends downwardly to a sixth guide through the middle rail 107. The fourth guide in the bottom of the head rail can be adjacent to—i.e., just to the right of—the third guide in the bottom of the head rail as shown schematically in FIGS. 2 and 3, but preferably the third and fourth guides in the head rail are coaxial. The sixth guide in the middle rail can be adjacent to—i.e., just to the right of—the fourth guide in the middle rail as shown schematically in FIGS. 2 and 3, but preferably the fourth and sixth guides in the middle rail are also coaxial. The other lift cord part 119B then extends downwardly through the sixth guide in the middle rail, and its other end 122 is fixed to the top of the bottom rail, midway between the ends of the bottom rail.

Thus, as seen from FIGS. 2 and 3, the first lift cord 117 is routed through the top section 103 of the blind 101 adjacent the apex 113 and long side 115 of the covering material 123 in the top section. The parts of the second lift cord 119 are routed through the top section 103 between the apex and long side 113,115 of the covering material 123 in the top section. The total length of the first lift cord 117 within the top section 103 is equal to the total length of the second lift cord 119 within the top section 103 when the covering material 123 is extended.

Preferably a spring 127 is also provided in the head rail 105, attached to a support wire 129. The spring 127 and support wire 129 prevent the right end of the middle rail 107 from pivoting downwardly below the left end of the middle rail.

When the cord member 125 is pulled downwardly, the cord collector 121 pulls the first and second pull cords 117, 119 outwardly of the blind 101. As shown in FIG. 3, this initially causes: the first pull cord 117 to pull up the wire loop 129 attached to the bottom rail 111 and thereby the right end of the bottom rail and the pull cord parts 119A, 119B to pull up the left end and middle of the bottom rail 111 until the middle and bottom rails are vertically adjacent to one another. When the cord member 125 is pulled further downwardly, this causes the first pull cord 117 to pull up the middle rail 107 at its first and second guides and to pull up further the wire loop 129 and the bottom rail 111 while the second pull cord parts pull up further the left end and middle of the bottom rail, so that both the middle and bottom rails pivot about the pivot center of the middle rail.

Figure 4:
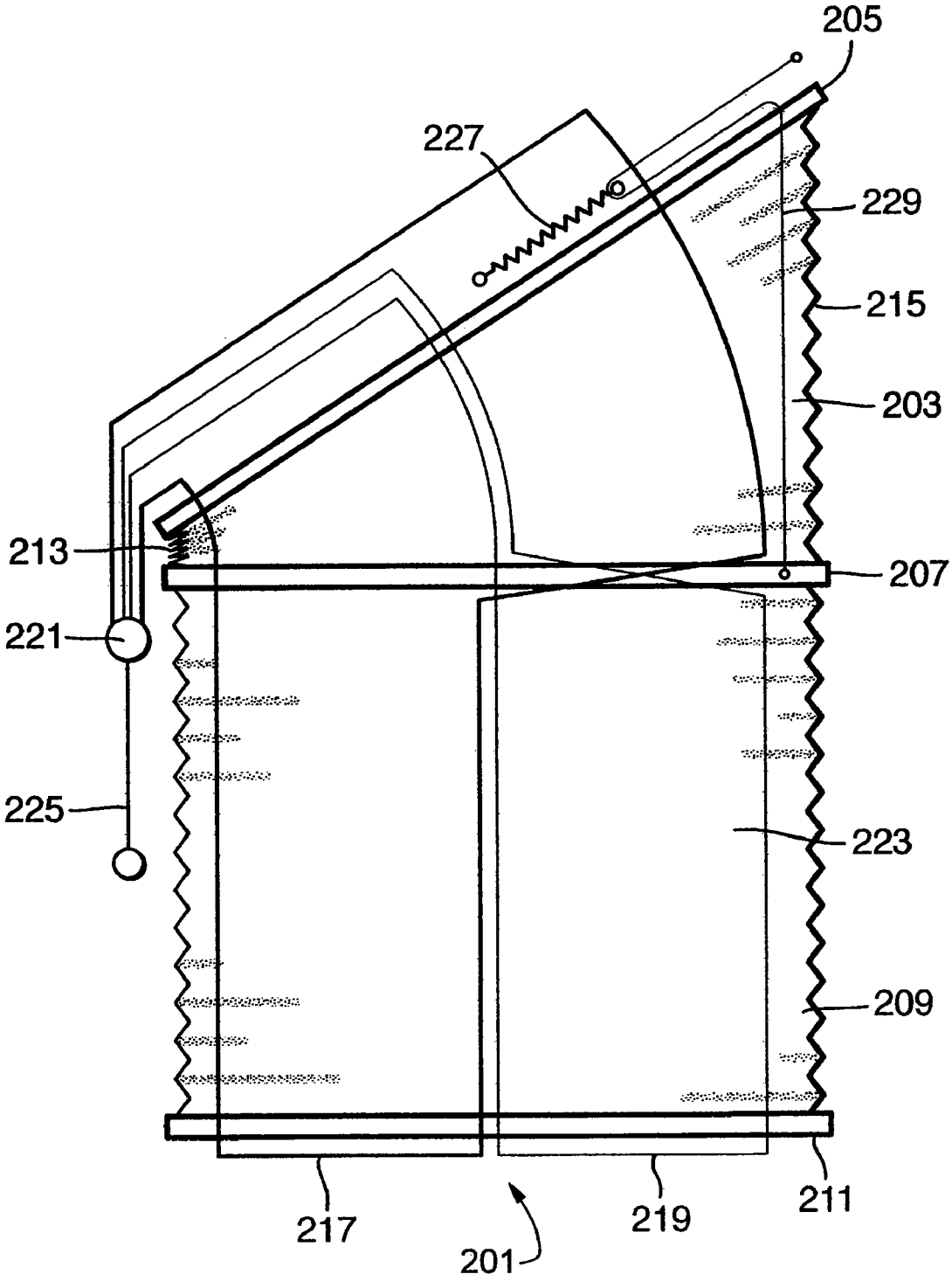
FIG. 4 is a schematic view of a third embodiment of a retractable blind assembly of this invention, with its pleated covering material extended.

FIG. 4 shows another embodiment of a blind 201 which is similar to the blind 1 of FIG. 1 and for which corresponding reference numerals (greater by 200) are used below for describing the parts or corresponding parts.

Blind 201 includes a fixed inclined head rail 205 and a raisable horizontally extending bottom rail 211. Between the head rail 205 and bottom rail 211 is a middle rail 207 that is pivotable with respect to the head rail 205 about a pivot center that is adjacent to the lowermost left end of the head rail. Attached to the top, middle and bottom rails 205, 207, 211 are a pair of lift cords 217, 219 which extend, between the rails, through perforations in a covering member 223, attached to the top, middle and bottom rails.

The head rail 205 and middle rail 207 and the triangular top portion of the covering member 223, attached to them, form a top section 203 of the blind 201 with an unattached short apex 213 about the pivot center of the top section and an opposite, unattached, long side 215 when the covering material extended. The middle rail 207 and bottom rail 211 and the rectangular bottom portion of the covering member 223, attached to them, form a bottom section 209 of the blind 201.

The blind 201 has a vertically movable cord collector 221 with a depending cord member 225 outside of the blind. The two lift cords 217, 219 are attached to the cord collector 221 and are routed through, and deflected by, the head, middle and bottom rails 205, 207, 211 as shown in FIG. 4.

Both ends of both lift cords 217, 219 are attached to the collector 221. The cord member 225 can be used to raise and lower the collector 221 to raise and lower the middle and bottom rails 207, 211 and thereby retract and extend the covering member 223 as described below.

The routing of the first lift cord 217 in the blind 201 in accordance with this invention is as follows (with reference to FIG. 4). The first lift cord 217 extends rightwardly through the head rail 205, away from the collector 221, to a first guide in the bottom of the head rail adjacent its left end. The first lift cord 217 extends downwardly from the first guide in the head rail to a first guide in the top of the middle rail 207 that is adjacent—i.e. just to the right of—the apex 213 of the covering material 223 in the top section 203 and adjacent the left end of the middle rail. The first lift cord 217 then extends downwardly through the first guide in the middle rail to a first guide in the bottom rail 211. The first lift cord 217 then extends rightwardly through the bottom guide 211 to a second guide in the bottom rail 211 generally midway between opposite ends of the bottom rail 211. It then extends upwardly to a second guide in the middle rail 207 and then extends rightwardly through the middle rail 207 to a third guide in the middle rail 207, adjacent its right end. The first lift cord 217 then extends upwardly from the third guide in the middle rail adjacent to—i.e. just to the left of—the long side 215 of the covering material 223 in the top section 203, to a second guide in the head rail 205, adjacent its right end. The lift cord then extends leftwardly through the head rail 205, from its second guide, back to the collector 221.

The second lift cord extends rightwardly through the head rail 205, away from its left end and the collector 221, and, at a third guide in the bottom rail 205—midway between the first and second guides in the headrail 205—it extends downwardly to a fourth guide in the top of the middle rail 207. The fourth guide in the bottom of the middle rail 207 can be adjacent to—i.e. just to the right of—the second guide in the top of the middle rail 207 as shown schematically in FIG. 4, but, preferably, the second and fourth guides in the middle rail are coaxial. The second lift cord then extends downwardly through the fourth guide in the middle rail 207 to a third guide in the bottom rail 211, midway between the ends of the bottom rail 211. The third guide in the bottom rail 211 can be adjacent to—i.e. just to the right of—the second guide in the bottom rail 211 as shown schematically in FIG. 4, but, preferably the second and third guides in the middle rail are coaxial. The second lift cord then extends rightwardly through the bottom rail 211 to a fourth guide in the bottom rail 211 at the right end of the bottom rail 211. The second lift cord 219 then extends upwardly from the fourth guide to a fifth guide in the middle 207 and then extends leftwardly through the middle 207 to a sixth guide. The sixth guide through the middle 207 can be adjacent—i.e. just to the right of—the fourth guide in the middle rail as shown schematically in FIG. 4, but, preferably, the fourth and fifth guides in the middle rail are coaxial. The second lift cord 219 then extends upwardly from the sixth guide in the middle rail to a fourth guide in the head rail 205 midway between the first and second guides. The fourth guide in the head rail 205 can be adjacent—i.e. just to the right of—the third guide in the head rail as shown schematically in FIG. 4, but, preferably, the third and fourth guides in the head rail are coaxial. The second lift cord 219 then extends leftwardly through the head rail, from its fourth guide, back to the collector 221.

The total length of the first lift cord 217 within the top section 203 is equal to the total length of the second lift cord 219 within the top section 213 when the covering material 223 is extended.

Preferably a spring 227 is also provided in the head rail 205, attached to a support wire 229. The spring 227 and support wire 229 prevent the right end of the middle rail 207 from pivoting downwardly below the left end of the middle 207.

When the cord member 225 is pulled downwardly, the cord collector 221 pulls the first and second pull cords 217, 219 outwardly of the blind 201. This initially causes the first pull cord to pull up the left end of the bottom rail 211 and the second pull cord to pull up the right end of the bottom rail 211 until the middle and bottom rails are vertically adjacent to one another. When the cord member 225 is pulled further downwardly, this causes the first pull cord 217 to pull up the middle rail 207 at its first and third guides, while the second pull cord pulls up the middle section of the middle rail.

Figure 5:
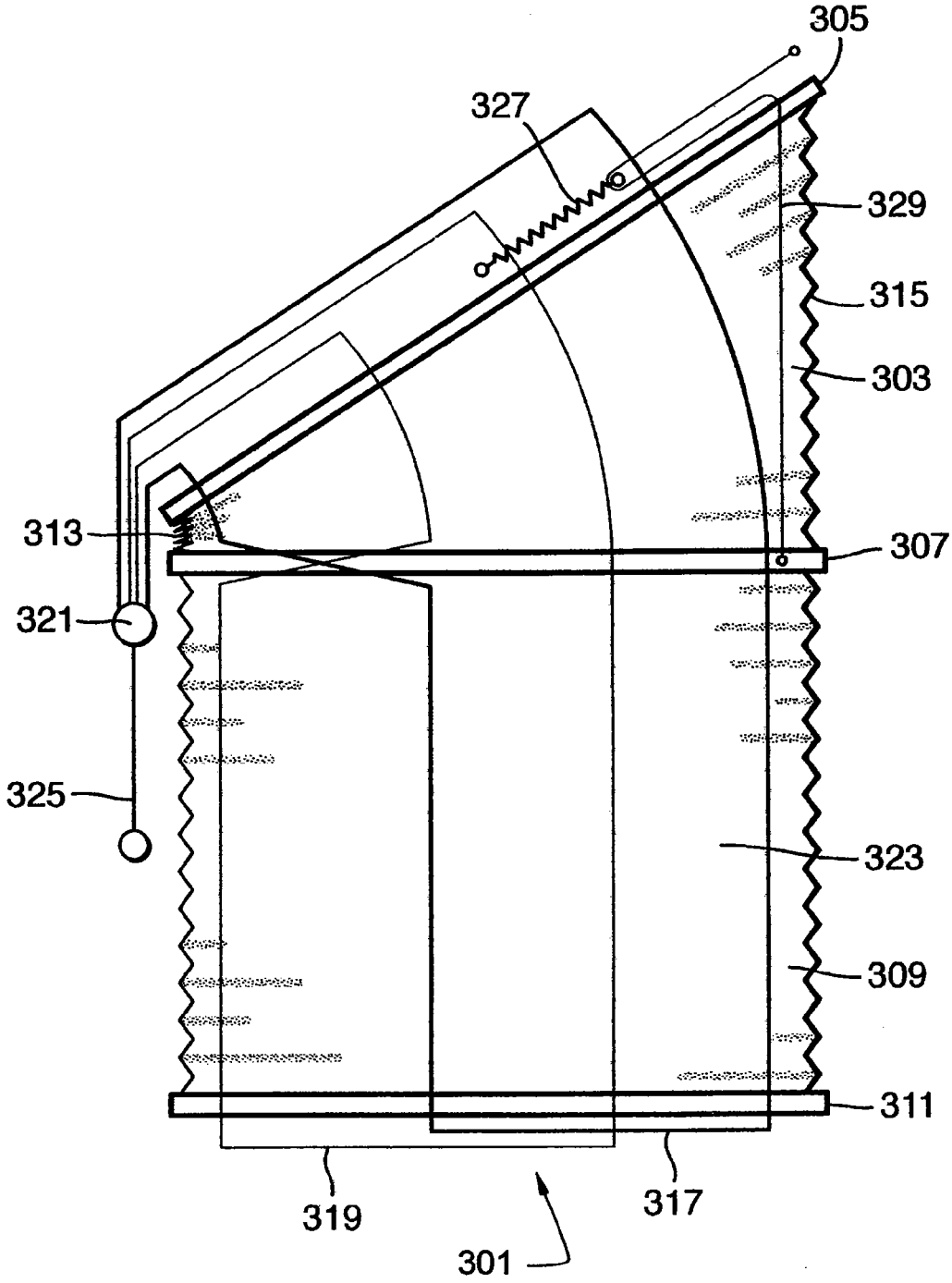
FIG. 5 is a schematic view of a fourth embodiment of a retractable blind assembly of this invention, with its pleated covering material extended.

FIG. 5 shows another embodiment of a blind 301 which is similar to the blind 1 of FIG. 1 and for which corresponding reference numerals (greater by 300) are used below for describing the parts or corresponding parts.

Blind 301 includes a fixed inclined head rail 305 and a raisable horizontally extending bottom rail 311. Between the head rail 305 and bottom rail 311 is a middle rail 307 that is pivotable with respect to the head rail 305 about a pivot center that is adjacent to the lowermost left end of the head rail. Attached to the top, middle and bottom rails 305, 307, 311 are a pair of lift cords 317, 319 which extend, between the rails, through perforations in a covering member 323, attached to the top, middle and bottom rails.

The head rail 305 and middle rail 307 and the triangular top portion of the covering member 323, attached to them, form a top section 303 of the blind 301 with an unattached short apex 313 about the pivot center of the top section and an opposite, unattached, long side 315 when the covering material extended. The middle rail 307 and bottom rail 311 and the rectangular bottom portion of the covering member 323, attached to them, form a bottom section 309 of the blind 301.

The blind 301 has a vertically movable cord collector 321 with a depending cord member 325 outside of the blind. The two lift cords 317, 319 are attached to the cord collector 321 and are routed through, and deflected by, the head, middle and bottom rails 305, 307, 311 as shown in FIG. 5.

Both ends of both of the lift cords 317, 319 are attached to the collector 321. The cord member 325 can be used to raise and lower the collector 321 to raise and lower the middle and bottom rails 307, 311 and thereby retract and extend the covering member 323 as described below.

The routing of the first lift cord 317 in the blind 301 in accordance with this invention is as follows (with reference to FIG. 5). The first lift cord 317 extends to the right through the headrail 305 away from the collector 321 to a first guide in the bottom of the headrail, adjacent its left end. The first lift cord 317 extends downwardly from the first guide in the head rail to a first guide in the top of the middle rail 307 that is adjacent—i.e. just to the right of—the apex 313 of the covering material 323 in the top section 303 and adjacent the left end of the middle rail. The first lift cord 317 then extends rightwardly through the middle 307 to a second guide in the bottom of the middle rail, partway across, for instance one third, and then extends downwardly to a first guide in the top of the bottom rail 311, again partway along, for instance a third, the length of the bottom rail 311. The first lift cord 317 then extends along the bottom rail 311 to a second guide in the bottom rail, adjacent its right end. The first lift cord 317 then extends upwardly from the second guide in the bottom rail up to a third guide in the middle rail 307, adjacent its right end. From the third guide in the middle rail 307, the first lift cord 317 then extends upwardly to a second guide in the head rail 305 towards its right end. The first lift cord then extends leftwardly through the head rail, from its second guide, back to the collector 321.

The second lift cord 319 extends rightwardly through the head rail 305, away from the collector 321, to a third guide in the bottom of the head rail 305, partway, for instance a third, along the head rail 305. The second lift cord 319 then extends downwardly to a fourth guide in the top of the middle rail 307 again partway, for instance a third, along the middle rail 307. The fourth guide of the middle rail 307 may be adjacent to the second guide of the middle 307, but, preferably coaxially above the second guide as illustrated schematically in FIG. 5. The second lift cord 319 then extends leftwardly through the middle 307 to a fifth guide in the bottom of the middle rail adjacent its left end. The fifth guide in the middle rail 307 may be adjacent to the first guide in the middle rail, but, preferably, is coaxially below the first guide as illustrated schematically in FIG. 5. The second lift cord 319 then extends downwardly from the fifth guide in the middle rail 307 to a third guide in the bottom rail 311 immediately adjacent to the left end of the bottom rail 311. The second lift cord 319 then extends rightwardly through the bottom rail 311 to a fourth guide partway, for instance two thirds, along the bottom rail 311. The second lift cord 319 then extends upwardly from the fourth guide in the bottom rail 311 to a sixth guide in the middle rail 307 partway, for instance two thirds, along the middle rail 307 from the left end and the apex 313. The second lift cord 319 then extends upwardly from the sixth guide in the middle rail to a fourth guide in the bottom of the headrail 305 partway, for instance two thirds, along its length from the left end. The second lift cord then extends leftwardly through the headrail, from its fourth guide, back to the collector 321.

The total length of the first lift cord 319 within the top section 303 is equal to the total length of the second lift cord 319 within the top section 303 when the covering material 323 is extended.

Preferably, a spring 327 is also provided in the headrail 305, attached to a support wire 329. The spring 327 and support wire 329 prevent the right end of the middle rail 307 from pivoting downwardly below the left end of the middle rail 307.

When the cord member 325 is pulled downwardly, the cord collector 321 pulls the first and second pull cords 317, 319 outwardly of the blind 301. This initially causes the first pull cord 317 to pull up the bottom rail 311 towards the right hand end and the second pull cord 319 to pull up the left hand end until the middle and bottom rails are vertically adjacent to one another. When the cord member 325 is pulled further downwardly, this causes the first pull cord to pull up the middle rail 307 at its third guide and to pull up further the bottom rail 311 while the second cord 319 pulls up the middle portion of the middle rail 307.

Figure 6:
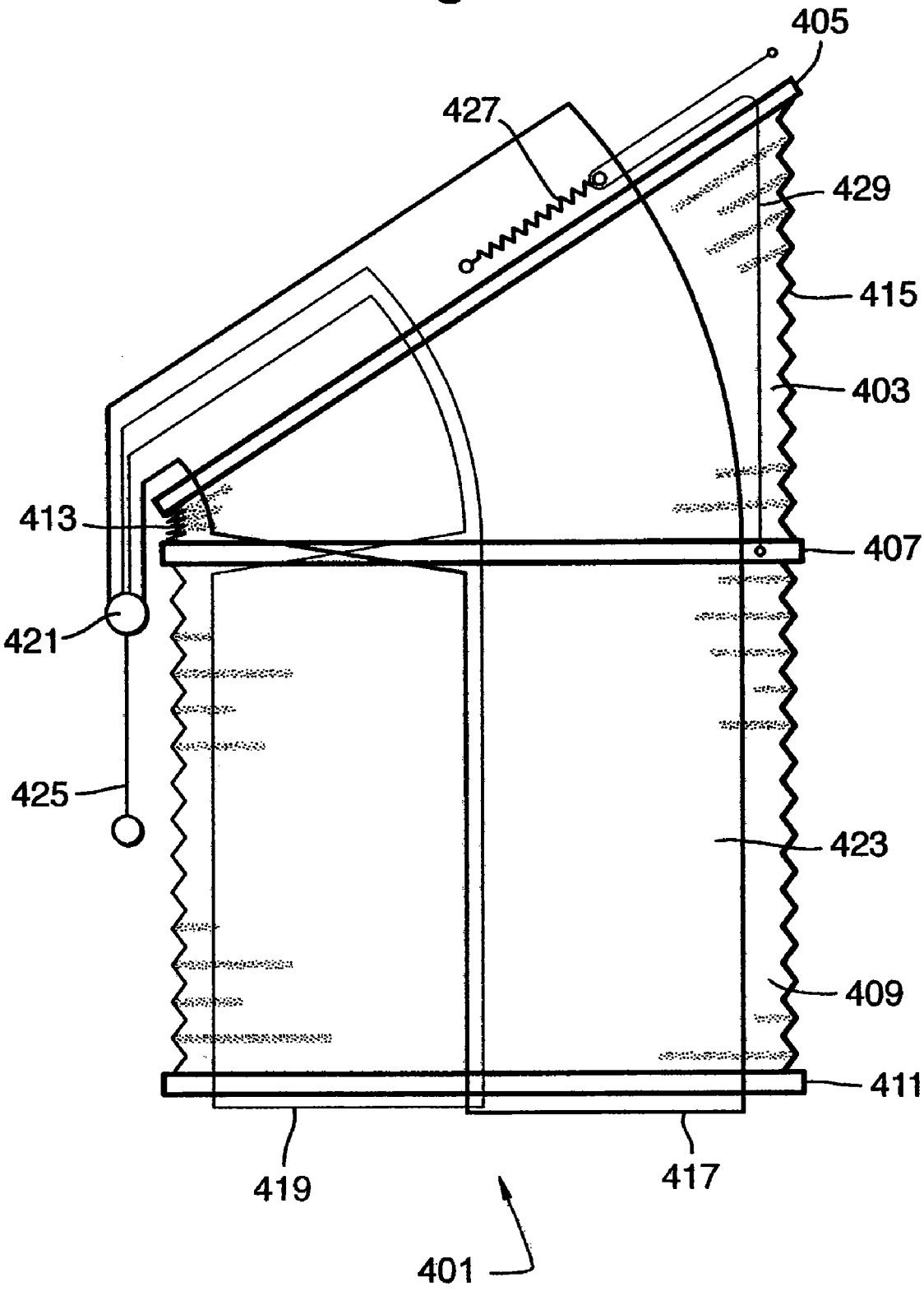
FIG. 6 is a schematic view of a fifth embodiment of a retractable blind assembly of this invention, with its pleated covering material extended.

FIG. 6 shows another embodiment of a blind 401 which is similar to the blind 1 of FIG. 1 and for which corresponding reference numerals (greater by 400) are used below for describing the parts or corresponding parts.

Blind 401 includes a fixed inclined head rail 405 and a raisable horizontally extending bottom rail 411. Between the head rail 405 and bottom rail 411 is a middle rail 407 that is pivotable with respect to the head rail 405 about a pivot center that is adjacent to the lowermost left end of the head rail. Attached to the top, middle and bottom rails 405, 407, 411 are a pair of lift cords 417, 419 which extend, between the rails, through perforations in a covering member 423, attached to the top, middle and bottom rails.

The head rail 405 and middle rail 407 and the triangular top portion of the covering member 423, attached to them, form a top section 403 of the blind 401 with an unattached short apex 413 about the pivot center of the top section and an opposite, unattached, long side 415 when the covering material is extended. The middle rail 407 and bottom rail 411 and the rectangular bottom portion of the covering member 423, attached to them, form a bottom section 409 of the blind 401.

The blind 401 has a vertically movable cord collector 421 with a depending cord member 425 outside of the blind. The two lift cords 417, 419 are attached to the cord collector 421 and are routed through, and deflected by, the head, middle and bottom rails 405, 407, 411 as shown in FIG. 6.

Both ends of both lift cords 417, 419 are attached to the collector 421. The cord member 425 can be used to raise and lower the collector 421 to raise and lower the middle and bottom rails 407, 411 and thereby retract and extend the covering member 423 as described below.

The routing of the first lift cord 417 in the blind 401 in accordance with this invention is as follows (with reference to FIG. 6). The first lift cord 417 extends rightwardly through the head rail 405 away from the collector 421 to a first guide in the head rail, adjacent its left end. The first lift cord 417 extends downwardly from the first guide in the head rail to a first guide in the top of the middle rail 407 that is adjacent—i.e. just to the right of—the apex 413 of the covering material 423 in the top section 403 and adjacent the left end of the middle rail. The first lift cord 417 then extends rightwardly through the middle rail 407 to a second guide in the bottom of the middle rail generally at the center of middle rail 407. It then extends downwardly to a first guide of the bottom rail 411 positioned generally half way along the bottom rail 411. The first lift cord 417 then extends along the bottom rail 411 to a second guide at the right end of the bottom rail 411 and, from the second guide, extends upwardly to a third guide of the middle rail 407. At the right end of the middle rail 407. The first lift cord 417 then extends upwardly from the third guide in the middle rail adjacent to—i.e. just to the left of—the long side 415 of the covering material 423 in the top section 403, to a second guide in the bottom of the head rail 405 adjacent its right end. The first lift cord then extends leftwardly through the head rail, from its second guide, back to the collector 421.

The second lift cord 419 extends rightwardly through the head rail 405, away from the collector 421, to a third guide in the bottom of the head rail 405 at a position generally half way along the head rail 405. The second lift cord 419 extends downwardly from the third guide in the head rail to a fourth guide in the top of the middle rail 407. The fourth guide of the middle rail 407 may be adjacent to the second guide of the middle rail 407, but, preferably, the fourth guide is position coaxially above the second guide as illustrated schematically in FIG. 6. The second lift cord 417 then extends leftwardly through the middle rail 407 to a fifth guide in the bottom of the middle rail 407 and adjacent its left end. The fifth guide may be adjacent the first guide, but, preferably, is positioned coaxially below the first guide as illustrated schematically in FIG. 6. The second lift cord then extends downwardly from the fifth guide of the middle rail 407 to a third guide of the bottom rail 411 at the left end of the bottom rail 411. The second lift cord 417 then extends rightwardly through the bottom rail 411 to a fourth guide in the bottom rail 411. The fourth guide through the bottom rail 411 can be adjacent—i.e. just to the right of—the first guide in the bottom rail 411 as shown schematically in FIG. 6, but, preferably, the first and fourth guides in the bottom rail are coaxial. The second lift cord 419 then extends upwardly from the fourth guide to a sixth guide in the middle rail 407. The sixth guide through the middle rail 407 can be adjacent—i.e. just to the right of—the second and fourth guides in the middle rail as shown schematically in FIG. 6, but, preferably, the sixth guide is coaxial with the second and fourth guides. From the sixth guide in the middle rail 407, the second lift cord 417 continues upwardly to a fourth guide in the head rail 405. The fourth guide through the head rail 405 can be adjacent—i.e. just to the right of—the third guide in the head rail as shown schematically in FIG. 6, but, preferably, the third and fourth guides in the head rail are coaxial. The second lift cord then extends leftwardly through the head rail 405, from its fourth guide, back to the collector 421.

The total length of the first lift cord 417 within the top section 403 is equal to the total length of the second lift cord 419 within the top section 403 when the covering material 423 is extended.

Preferably, a spring 427 is also provided in the head rail 405, attached to a support wire 429. The spring 427 and support wire 429 prevent the right end of the middle rail 407 from pivoting downwardly below the left end of the middle rail.

When the cord member 425 is pulled downwardly, the cord collector 421 pulls the first and second pull cords 417, 419 outwardly of the blind 401. This initially causes the first pull cord 417 to pull up the right-hand section of the bottom rail 411 and the second pull cord 419 to pull up the left-hand section of the bottom rail 411. When the cord member 425 is pulled further downwardly, this causes the first pull cord 417 to pull up the middle rail 407 at its first and third guides and to pull up further the bottom rail 411 while the second pull cord pulls up further the left end and middle of the bottom rail 411 so that both the middle and bottom rails pivot about the pivot center of the middle rail.

Figure 7:
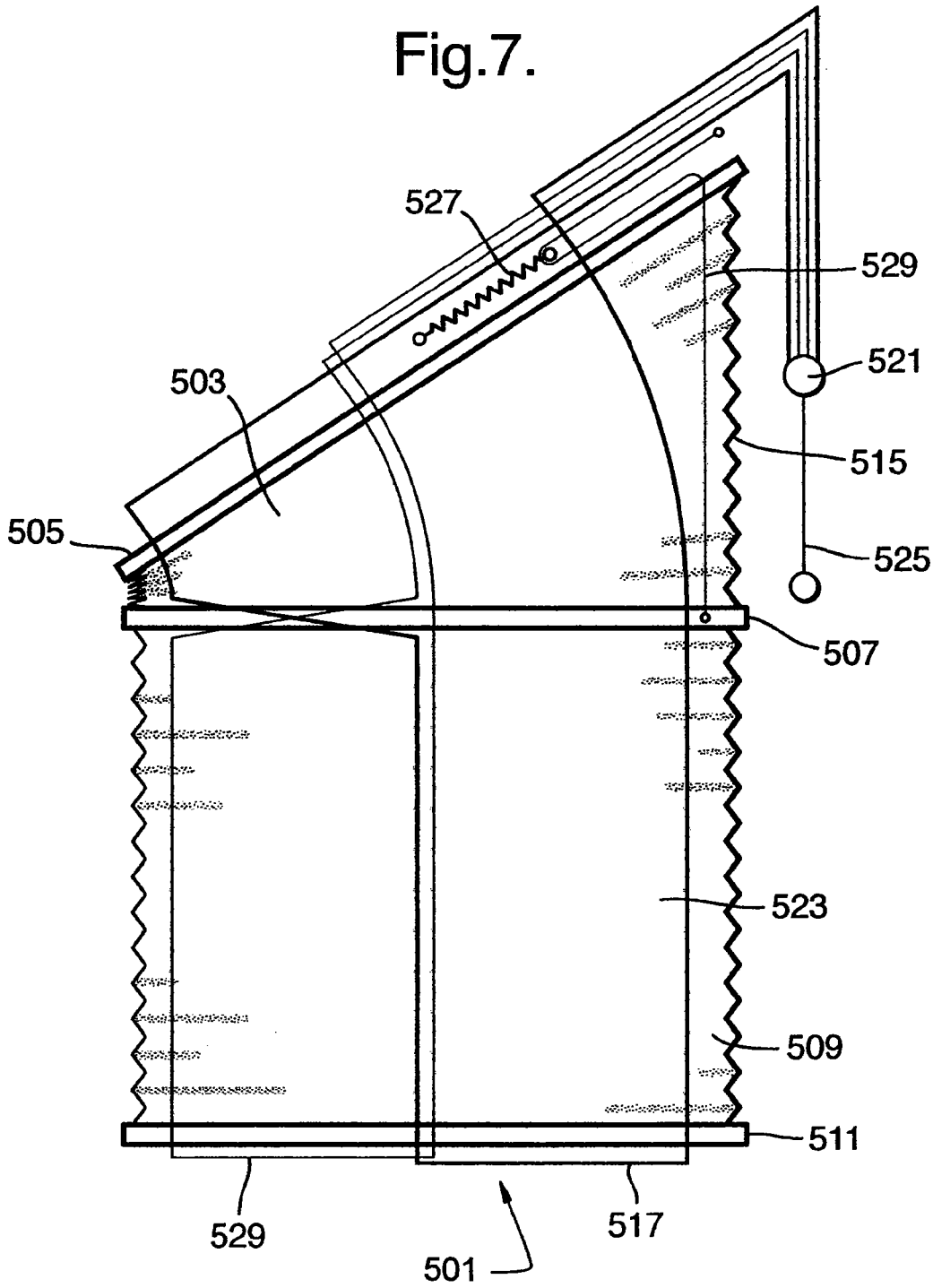
FIG. 7 is a schematic view of a sixth embodiment of a retractable blind assembly of this invention, with its pleated covering material extended.

FIG. 7 shows another embodiment of a blind 501 which is similar to the blind 1 of FIG. 1 and for which corresponding reference numerals (greater by 500) are used below for describing the parts or corresponding parts.

Blind 501 includes a fixed inclined head rail 505 and a raisable horizontally extending bottom rail 511. Between the head rail 505 and bottom rail 511 is a middle rail 507 that is pivotable with respect to the head rail 505 about a pivot center that is adjacent to the lowermost left end of the head rail. Attached to the top, middle and bottom rails 505, 507, 511 are a pair of lift cords 517, 519 which extend, between the rails, through perforations in a covering member 523, attached to the top, middle and bottom rails.

The head rail 505 and middle rail 507 and the triangular top portion of the covering member 523, attached to them, form a top section 503 of the blind 501 with an unattached short apex 513 about the pivot center of the top section and an opposite, unattached, long side 515 when the covering material is extended. The middle rail 507 and bottom rail 511 and the rectangular bottom portion of the covering member 523, attached to them, form a bottom section 509 of the blind 501.

The blind 501 has a vertically movable cord collector 521 with a depending cord member 525 outside of the blind. The two lift cords 517, 519 are attached to the cord collector 521 and are routed through, and deflected by, the head, middle and bottom rails 505, 507, 511 as shown in FIG. 7.

The arrangement of the first and second lift cords 517, 519 within the blind itself is identical to the embodiment of FIG. 6. However, the collector 521 and cord member 525 are positioned on the right side of the blind 501, i.e. just to the right of the long side 515 of the covering material 523 in the top section 503. The first and second lift cords 517, 519 therefore run in an opposite direction (in terms of left and right) from the collector 521.

It will be appreciated that the cord collector and the cord member 525 can be repositioned in this way for any embodiment.

Figure 8:
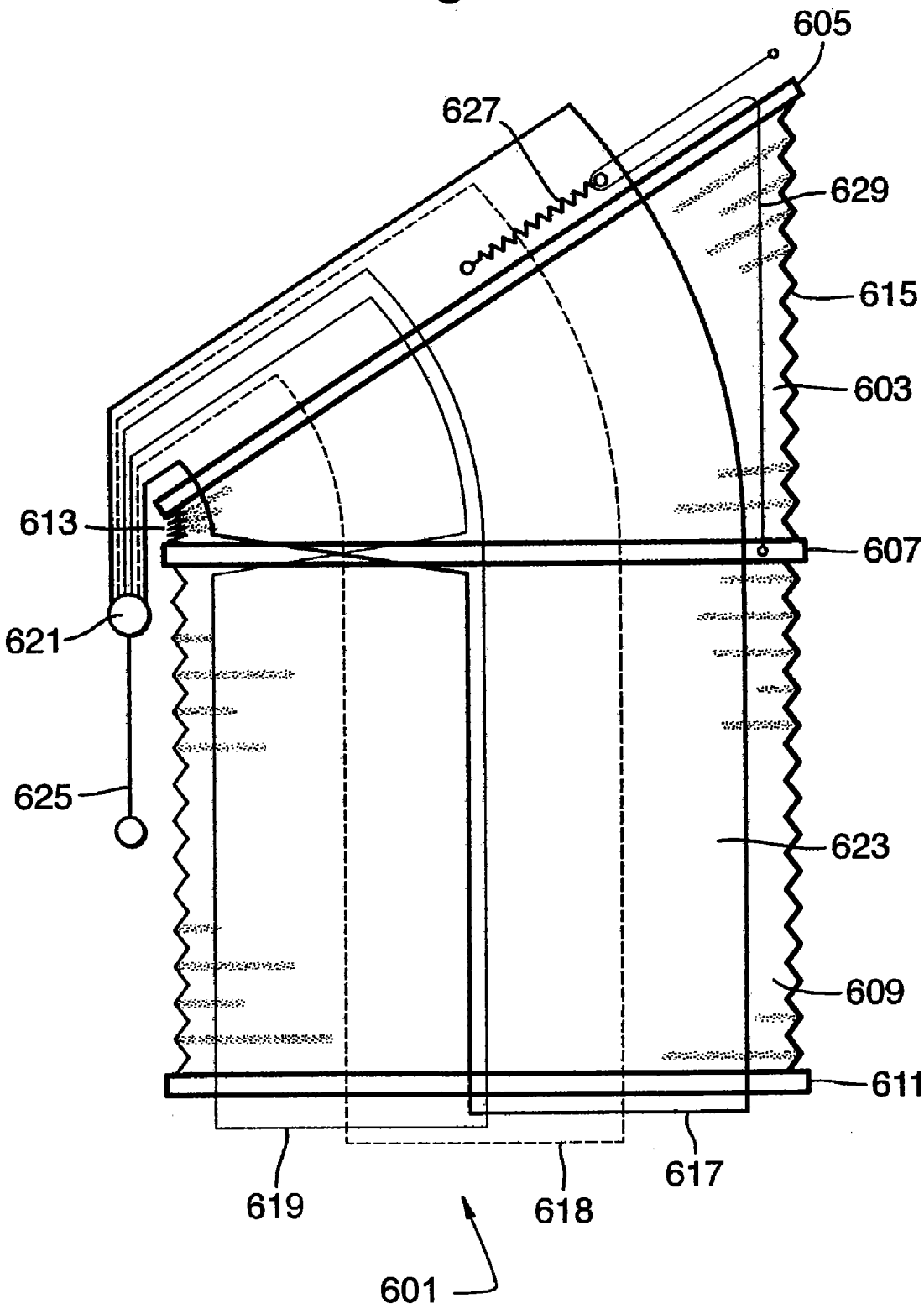
FIG. 8 is a schematic view of a seventh embodiment of a retractable blind assembly of this invention, with its pleated covering material extended.

FIG. 8 shows another embodiment of a blind 601 which is similar to the blind 1 of FIG. 1 and for which corresponding reference numerals (greater by 600) are used below for describing the same parts of corresponding parts. The blind differs most significantly from the blind 1 of FIG. 1 by having three, rather than two lift cords.

The blind 601 includes a fixed inclined head rail 605 and a raisable horizontally extending bottom rail 611. Between the head rail 605 and bottom rail 611 is a middle rail 607 that is pivotable with respect to the head rail 605 about a pivot center that is adjacent to the lowermost left end of the head rail. Attached to the top, middle and bottom rails 605, 607, 611 are three lift cords 617, 618 and 619 which extend between the rails through perforations in a covering member 623 attached to the top, middle and bottom rails.

The head rail 605 and middle rail 607 and the triangular top portion of the covering member 623, attached to them, form a top section 603 of the blind 601 with an unattached short apex 613 about the pivot center of the top section and an opposite, unattached long side 615 when the covering material is extended. The middle rail 607 and bottom rail 611 and the rectangular bottom portion of the covering member 623, attached to them, form a bottom section 609 of the blind 601.

The blind 601 has a vertically movable cord collector 621 with a depending cord member 625 outside of the blind. Three lift cords 617, 618, 619 are attached to the cord collector 621 and are routed through, and deflected by, the head, middle and bottom rails 605, 607, 611 as shown in FIG. 8. Both ends of all three lift cords 617, 618, 619 are attached to the collector 621. The cord member 625 can be used to raise and lower the collector 621 to raise and lower the middle and bottom rails 607, 611 and thereby retract and extend the covering member 623 as described below.

The embodiment of FIG. 8 is identical to that of FIG. 6 other than the addition of the third lift cord 618. The routing of the first lift cord 617 and second lift cord 619 is the same as was described for the first lift cord 417 and second lift cord 419 of FIG. 6. Hence, this description will not be repeated here.

The routing of the third lift cord 618 in the blind 608 in accordance with this invention is as follows (with reference to FIG. 8). The third lift cord 618 extends to the right through the head rail 605, away from the collector 621, to a fifth guide in the bottom of the head rail someway, for instance a quarter of the way, from the left end of the head rail 605. The third lift cord 618 extends downwardly from the fifth guide in the head rail to a seventh guide in the top of the middle rail 607 that similarly is someway, for instance a quarter of the way, from the left end of the middle rail 607 and, hence, the apex 613 of the covering material 623. The third lift cord 618 then extends downwardly from the seventh guide of the middle rail 607 to a fifth guide of the bottom rail 611. Similarly, the fifth guide of the bottom rail 611 is positioned someway, for instance a quarter of the way, from the left end of the bottom rail 611. The third lift cord 618 then extends rightwardly through the bottom rail 611 to a sixth guide in the bottom rail 611 which is someway, for instance three quarters of the way, from the left end of the bottom rail 611. The third lift cord 618 then extends upwardly to an eighth guide in the middle rail 607 again someway, for instance three quarters of the way, from the left end of the middle rail 607. The third lift cord 618 extends through the eighth guide of the middle rail 607 and then upwardly to a sixth guide of the head rail 605 which, again, is someway, for instance three quarters of the way, from the left end of the head rail 605. The third lift cord then extends leftwardly through the head rail, from its fifth guide, back to the collector 621.

The total length of the third lift cord 618 within the top section 603 is equal to the total length of the first lift cord 617 within the top section 103 and also to the total length of the second lift cord 619 within the top section 603 when the covering material 623 is extended. The positioning of the fifth and sixth guides in the head rail 605 and the seventh and eighth guides in the middle rail 607 and the fifth and sixth guides in the bottom rail 611 can be varied in any way, provided that this condition is met.

When the cord member 625 is pulled downwardly, the cord collector 621 pulls the first, second and third pull cords 617, 619, 618 outwardly of the blind. The first and second pull cords 617 and 619 operate as described for FIG. 6. The third pull cord 619 initially pulls up the bottom rail 611 at mid-sections along its length and then causes the middle and bottom rails to pivot about the pivot center of the middle rail.

It will be appreciated that third or further cords could be added to any of the embodiments. Third or further cords help provide a more evenly distributed lifting and rotating force on the bottom and middle rails.

This invention is, of course, not limited to the above-described embodiments which may be modified without departing from the scope of the invention or sacrificing all of its advantages. In this regard, the terms in the foregoing description and the following claims, such as "top", "middle", "bottom", "left", "right", "vertical" and "horizontal", have been used only as relative terms to describe the relationships of the various elements of the blind of the invention. For example, the blind covering material 23,123 need not be a pleated blind material but can be any flexible material sheet member that is foldable, pleatable or rollable. The blind covering material can also be formed as a collapsible slatted blind in which the vanes or slats may be pivotally adjustable for additional light regulation. Likewise, the movable middle rail 7,107 and bottom rail 11,111 can be either directly or indirectly attached to the covering material 23,123 in the top section 3,103 and bottom section 9, 109 of the blind 1,101 in order to extend and retract the top and bottom sections.

The invention claimed is:

1. A retractable blind assembly (1,101) including:

a top section (3,103) with a vertically-extending blind covering material (23,123) extending between a fixed inclined head rail (5,105) and a middle rail (7,107) that is pivotable with respect to the head rail (5,105) about a pivot center that is adjacent to a lowermost end of the head rail; the head rail extending upwardly at an acute angle; the middle rail (7,107) being pivotable between a lower position, in which the middle rail extends horizontally, when the covering material is extended and an upper position, in which the middle rail extends upwardly at an acute angle and is adjacent the head rail, when the covering material is retracted; the covering material in the top section (3,103) having a generally triangular shape with an unattached short apex (13,113) about the pivot center and an opposite, unattached, long side (15,115) when the covering material is extended;

a bottom section (9,109) with the covering material extending between the middle rail (7,107) and a horizontally-extending bottom rail (11,111); the bottom rail being movable vertically between the bottom of the blind when the covering material is extended and an upper position, adjacent the middle rail, when the covering material is retracted;

only first and second unitary lift cords (17, 19, 117, 119) for extending and retracting the covering material; the lift cords being connected outside the blind to a cord connector (21,121);

characterized in that the first lift cord (17,117) is routed through the top section (3,103) adjacent its apex and long side (13,15,113,115) and the second lift cord (19,119) is routed such that it passes through the top section between its apex and long side, and wherein when the covering material (23,123) is extended, the total length of the first lift cord (17,117) within the top section (3,103) is equal to the total length of the second lift cord (19,119) within the top section.

2. The blind assembly of claim 1 wherein the first lift cord (17) is routed in a closed loop and the second lift cord (19) is also routed in a closed loop, and wherein each lift cord has two cord ends and both cord ends of each lift cord are connected to the cord connector (21).

3. The blind assembly of claim 1 wherein the first lift cord (117) is routed in a closed loop having its cord ends connected to the cord connector (121) and the second lift cord (119) comprises a first lift cord part (119A) and a second lift cord lift cord part (119B), the first and second lift cord parts each having one of its cord ends (120) connected to the cord connector (121) and its other cord end (122) connected to the bottom rail (107).

4. The blind assembly of claim 1 wherein the top section (3,103) and bottom section (9,109) of the covering material comprise a single piece of the covering material.

5. The blind assembly of claim 2 wherein the top section (3,103) and bottom section (9,109) of the covering material comprise a single piece of the covering material.

6. The blind assembly of claim 3 wherein the top section (3,103) and bottom section (9,109) of the covering material comprise a single piece of the covering material.

7. The blind assembly claim 1 wherein the at least first and second lift cords include a third lift cord (618).

8. The blind assembly of claim 2 wherein the at least first and second lift cords include a third lift cord (618).

9. The blind assembly of claim 3 wherein the at least first and second lift cords include a third lift cord (618).

10. The blind assembly of claim 4 wherein the at least first and second lift cords include a third lift cord (618).

11. The blind assembly of claim 5 wherein the at least first and second lift cords include a third lift cord (618).

12. The blind assembly of claim 6 wherein the at least first and second lift cords include a third lift cord (618).

13. The blind assembly of claim 1 which is a pleated blind.

14. The blind assembly of claim 2 which is a pleated blind.

15. The blind assembly of claim 3 which is a pleated blind.

16. The blind assembly of claim 4 which is a pleated blind.

17. The blind assembly of claim 7 which is a pleated blind.

* * * * *